US008635966B2

(12) United States Patent
Bachmann

(10) Patent No.: US 8,635,966 B2
(45) Date of Patent: Jan. 28, 2014

(54) LAMINAR AIR FLOW SLOT VENTING FOR SAILS

(76) Inventor: Helmuth G. Bachmann, Salinas, CA (US)

( * ) Notice: Subject to any disclaimer, the term of this patent is extended or adjusted under 35 U.S.C. 154(b) by 0 days.

(21) Appl. No.: 13/429,361

(22) Filed: Mar. 24, 2012

(65) Prior Publication Data

US 2013/0247809 A1 Sep. 26, 2013

(51) Int. Cl.
*B63H 9/04* (2006.01)

(52) U.S. Cl.
USPC ..... 114/102.13; 114/102.14; 114/102.26; 114/106

(58) Field of Classification Search
USPC ..... 114/102.1–102.18, 102.1–102.24
See application file for complete search history.

(56) References Cited

U.S. PATENT DOCUMENTS

| | | | | |
|---|---|---|---|---|
| 2,971,488 | A | 2/1961 | Morissette | |
| 2,984,199 | A | 5/1961 | Giewald | |
| 3,053,219 | A | 9/1962 | Coon | |
| 3,776,170 | A | 12/1973 | Slemmons | |
| 4,006,701 | A * | 2/1977 | Corbellini | 114/102.24 |
| 4,848,258 | A | 7/1989 | Priebe | |
| 4,864,954 | A * | 9/1989 | Farrar | 114/102.24 |
| 5,031,560 | A * | 7/1991 | Stearns, IV | 114/102.13 |
| 5,038,699 | A * | 8/1991 | Cochran et al. | 114/97 |
| 5,123,368 | A * | 6/1992 | Tran et al. | 114/102.13 |
| 5,603,276 | A * | 2/1997 | Julien | 114/39.21 |
| 5,732,643 | A | 3/1998 | Neuhaus | |
| 6,588,353 | B2 * | 7/2003 | Doyle et al. | 114/102.25 |
| 2009/0074578 | A1 | 3/2009 | Dewar | |

* cited by examiner

*Primary Examiner* — Lars A Olson
*Assistant Examiner* — Jovon Hayes

(57) ABSTRACT

This invention relates to the use of a venting assembly for conventional sails, comprising one or more aperture substantially perpendicular with the sail surface separating a fore and aft element of the sail. The aperture channels high energy air flow from the windward side of the sail through to the leeward side of the sail parallel to the sail surface, energizing the surface boundary layer and maintaining laminar air flow along the aft element of the sail.

5 Claims, 6 Drawing Sheets

LAMINAR AIR FLOW SLOT VENTING FOR SAILS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

This invention relates to the use of laminar air flow slot venting for sails such as a headsail, mainsail or asymmetrical spinnaker used on most sailboats. The state of the art designs for the use of slot venting between two elements or sail sections are found on wing sails, such as the BMW Oracle racing USA-17 trimaran in Americas Cup 2010, where air flows from the windward side of the sail and aftward along the leeward side of the aft element or flap, which concept originated with slotted aircraft landing flaps. The C-Class catamaran is similar in design, although has an additional flap between the two element sections which helps direct windward air flow aftward closer and more parallel to the leeward side of the aft element, further energizing laminar air flow along the surface boundary layer. These designs allow for higher angles of attach with more camber generating higher lift and drag ratios which is desirable for stable high performance multihulled sailboats. Numerous US patents for hard wing sails utilize a slot to direct windward air flow aftward along the leeward side, as well as U.S. Pat. No. 5,732,643 of a "sail". Although, in U.S. Pat. No. 5,732,643 the first element or "head sail" is wing shaped out to it's leach, and made of rigid or braced segments which pivot substantially about the mast, unlike a sail having a thin airfoil shape. U.S. Pat. Nos. 5,031,560, 5,123,368 3,776,170 and 2,971,488 for sails, all have open vents with apertures parallel to the sail's surface and direct air flow from the windward side to the leeward side of the sail substantially outward from the surface, and not directly aftward along the aft section of the sail as in the description for this invention.

BRIEF SUMMARY OF THE INVENTION

It is the object of this invention to disclose the drawbacks of existing prior art for venting on sails, and provide a venting assembly for a sail similar to the most efficient state of the art slot venting on wing sails, channeling high energy air from the windward surface of the sail through to the leeward aft element, and energizing the surface boundary layer to help maintain laminar air flow.

It is a further object to the present invention to provide a venting assembly on a sail which is an improvement in vent shape over the state of the art wing sails by directing air flow parallel to the surface boundary layer of the aft element.

It is a further object to the present invention to provide a venting assembly on a sail which will help maintain laminar air flow along a sail with increasing sail camber and angle of attach and require less trimming.

It is a further object to the present invention to provide a venting assembly with controls for regulating the amount of air flow from the windward side to the leeward side of a sail.

BRIEF DESCRIPTION OF THE SEVERAL VIEWS OF THE DRAWING

Corresponding reference numerals designate corresponding parts throughout several views of the drawings.

DETAILED DESCRIPTION OF THE INVENTION

Figure 1:
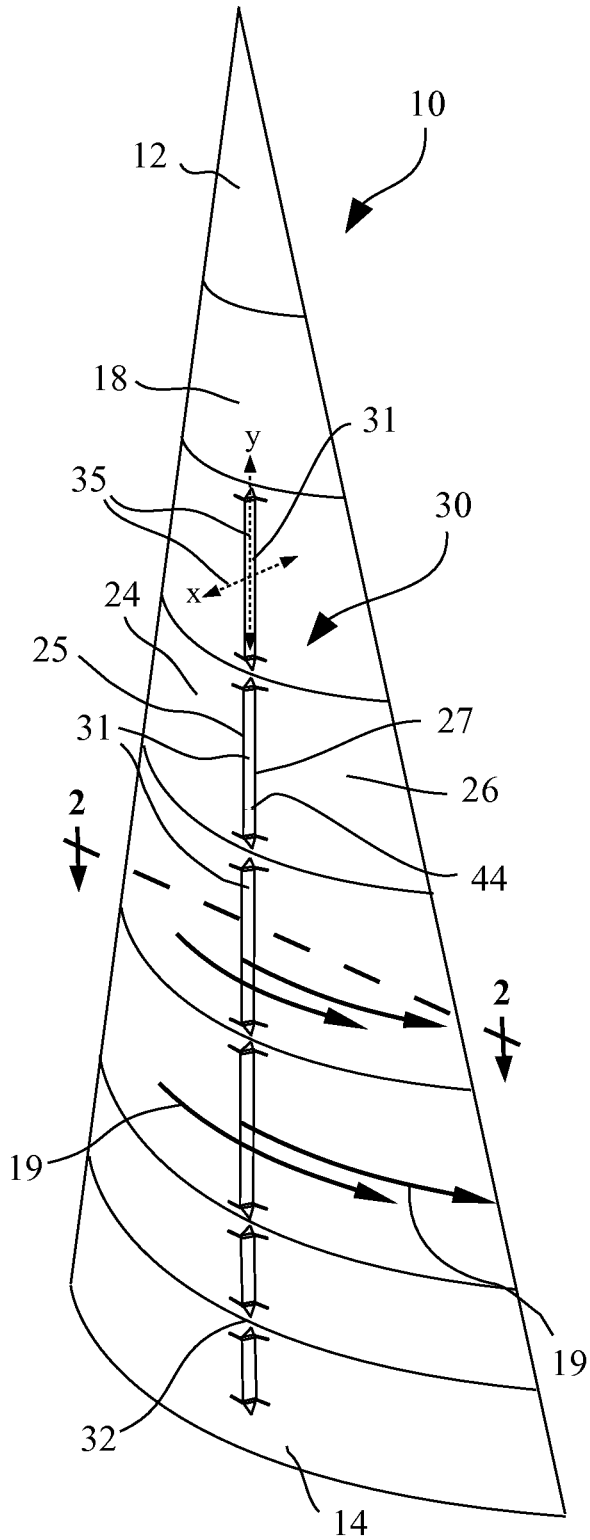
FIG. 1 is a perspective view of a sail having a venting assembly embodying the invention.
Figure 2:
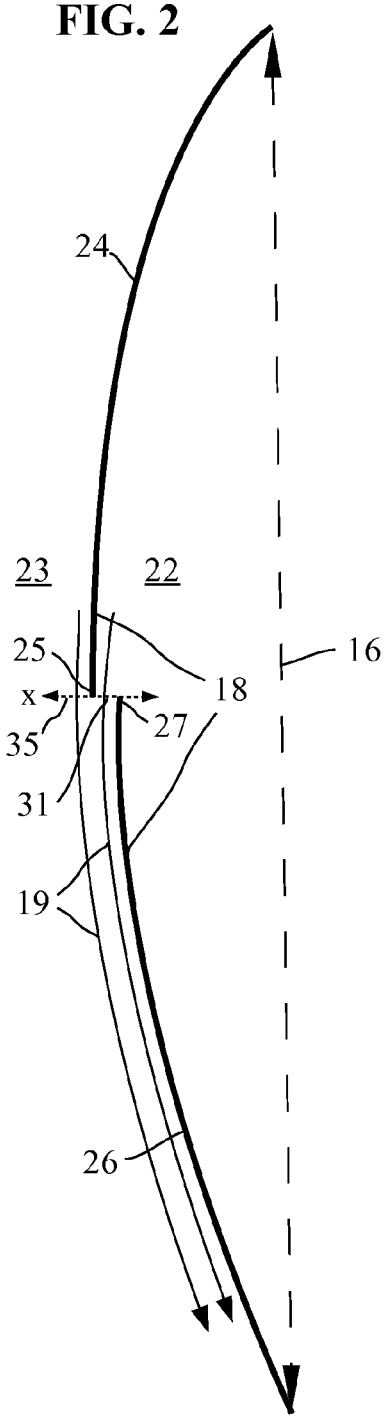
FIG. 2 is a sectional view taken substantially along line 2-2 in FIG. 1 of a sail including venting assembly aperture and air flow.
Figure 3:
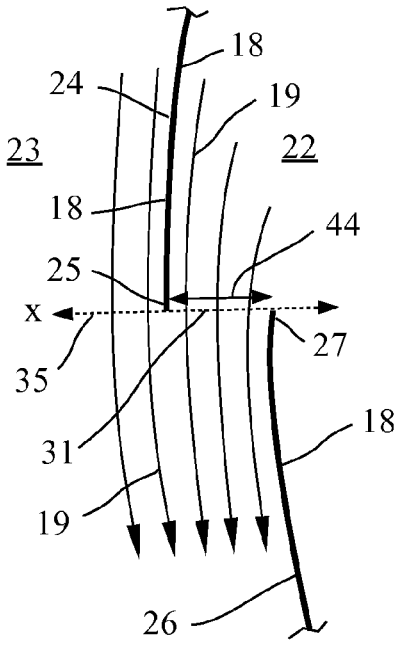
FIG. 3 is an expanded sectional view of the venting assembly aperture and air flow.
Figure 4:
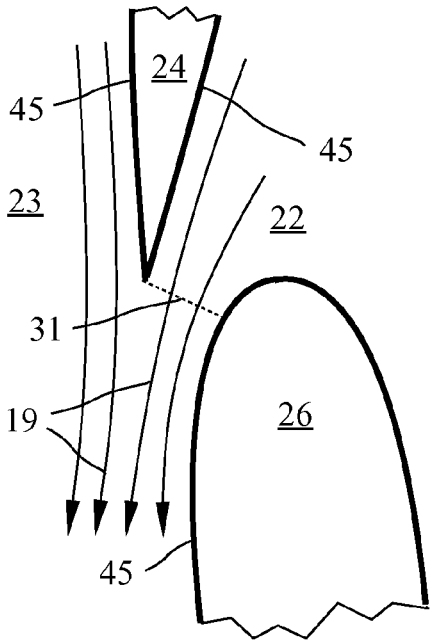
FIG. 4 is a sectional view of the venting aperture on a wing sail and air flow.
Figure 5:
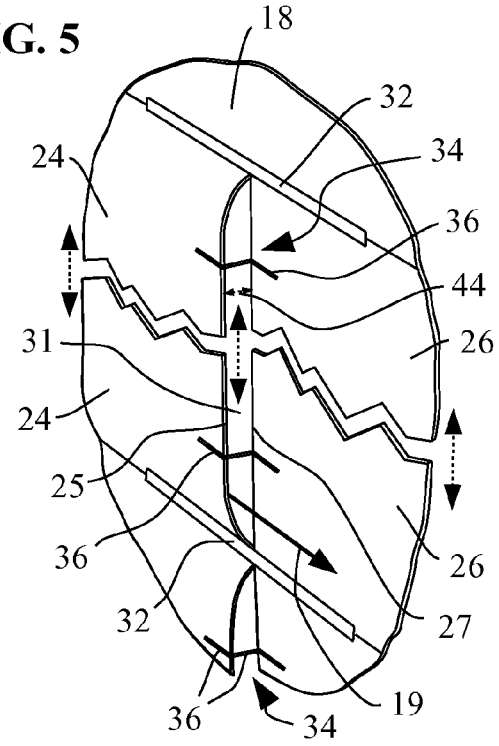
FIG. 5 is a perspective view of an aperture having a spacer line aperture control element.
Figure 6:
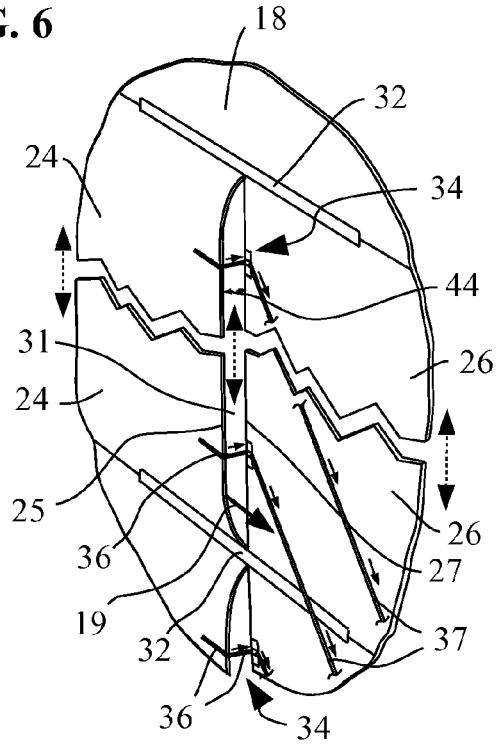
FIG. 6 is a perspective view of an aperture having a spacer control line connected to each spacer line.

Referring now to the drawings, and more particularly to FIGS. 1 through 3, a sail 10 comprised of a thin airfoil material with a sail surface 18 having a venting assembly 30 comprising one or more aperture 31 having an aperture gap 44 separating a fore element 24 having a fore element leach edge 25 and an aft element 26 having a aft element luff edge 27 forming the aperture 31. Each aperture 31 is coplanar having an in-plane axis 35 substantially perpendicular with respect to the sail surface 18 and the fore element leach edge 25 of the fore element 24 is disposed substantially adjacent with the aft element luff edge 27 of the aft element 26 while under sail. Each aperture 31 is positioned substantially vertical and in-line perpendicular to air flow 19 and the high energy air flow 19 from the windward side 22 of the sail 10 is channeled through the aperture 31 to the leeward side 23 parallel to the leeward side 23 sail surface 18 of the aft element 26. The venting assembly 30 takes advantage of the thin airfoil shape of the fore element 24 having the windward side 22 sail surface 18 parallel to the leeward side 23 sail surface 18 as shown in cross sectional FIG. 2 and expanded in FIG. 3. Air flow 19 parallel to the leeward side 23 sail surface 18 energizes the boundary layer along the aft element 26, and draws air flow 19 toward the sail surface 18 maintaining laminar air flow 19 and increasing lift without stalling the sail 10. Where as on the state of the art wing sail of the BMW Oracle racing USA-17 trimaran, the windward side 22 of the wing surface 45 is not parallel to the leeward side 23 of the wing surface 45 and directs air flow 19 at an unfavorable angled outward from the wing surface 45 of the aft element 26 as shown in FIG. 4, and any modifications as on the C-Class catamaran to redirect air flow 19 is complex and induces additional drag.

Figure 7:
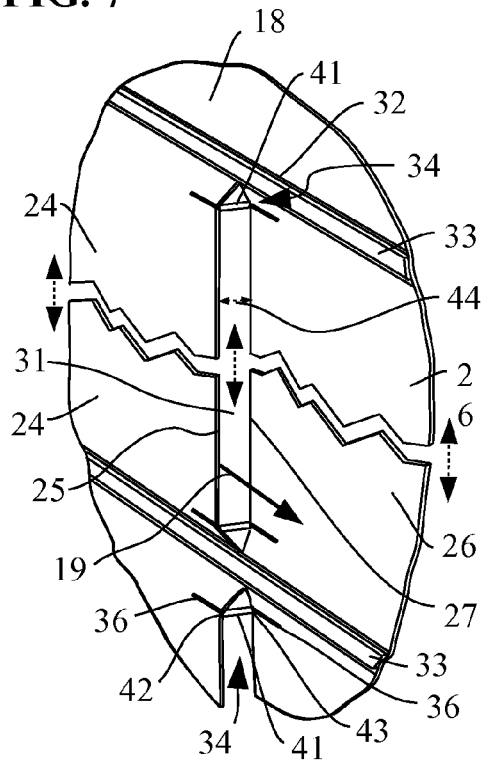
FIG. 7 is a perspective view of an aperture having the spacer line with a spreader tube.
Figure 8:
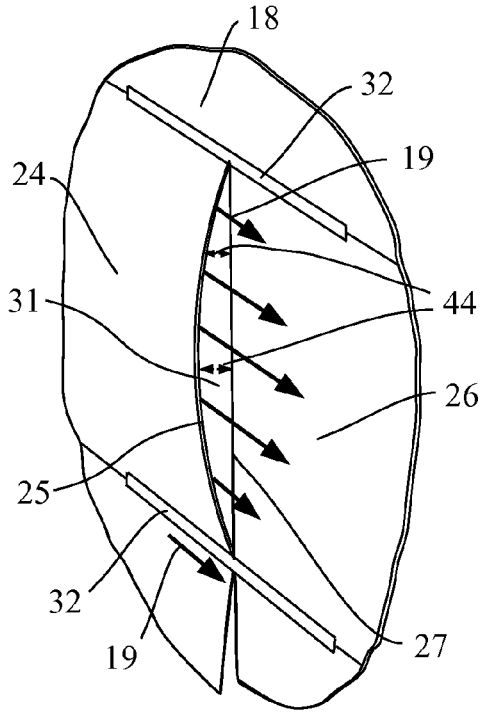
FIG. 8 is a perspective view of an aperture without aperture control element.
Figure 9:
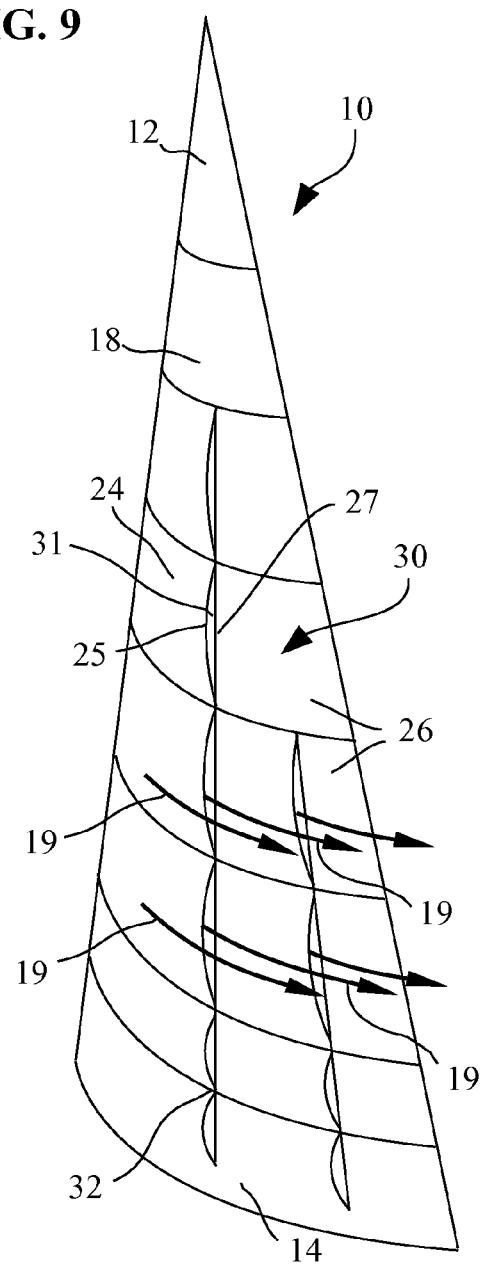
FIG. 9 is a perspective view of a sail having venting assembly with aperture sharing a fore and aft element.
Figure 10:
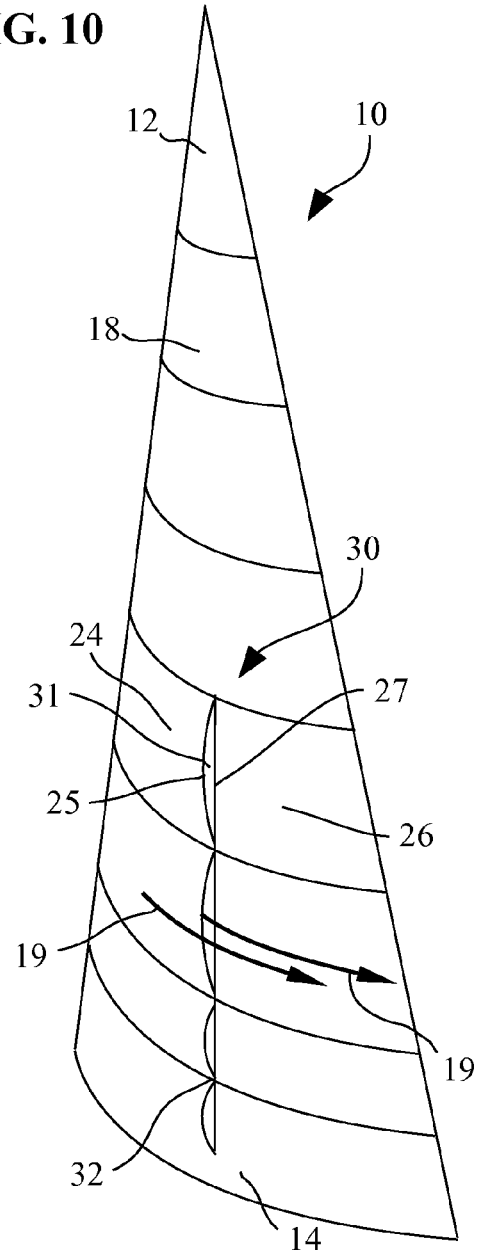
FIG. 10 is a perspective view of a sail having aperture limited substantially proximal to the foot.
Figure 11:
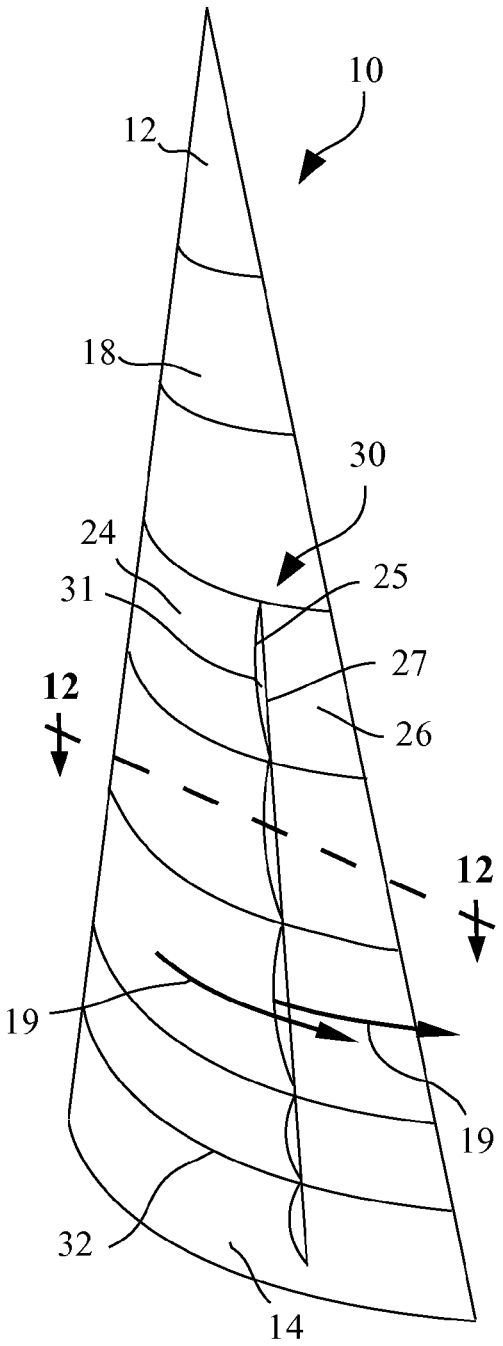
FIG. 11 is a perspective view of a sail having aperture substantially proximal to the leach.
Figure 12:
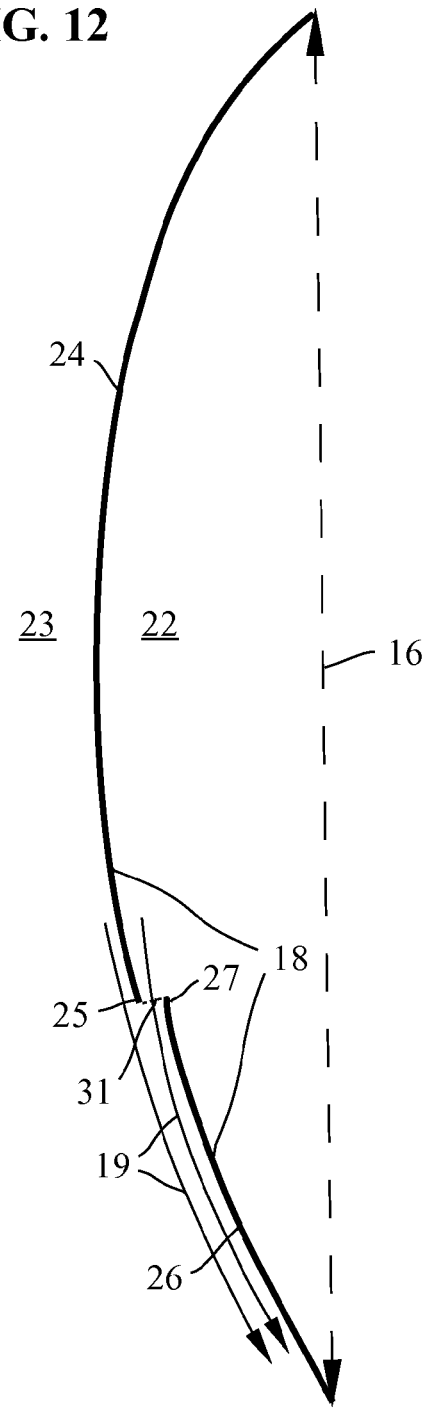
FIG. 12 is a sectional view taken substantially along line 12-12 in FIG. 11 of a sail including venting assembly aperture and air flow.
Figure 13:
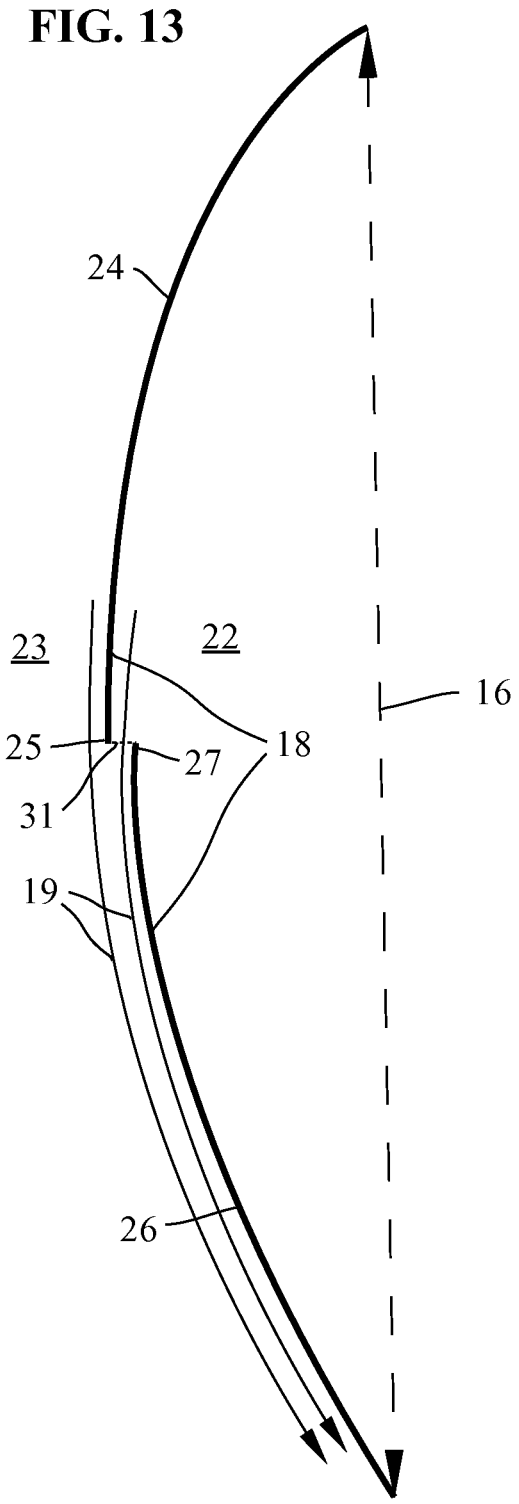
FIG. 13 is a sectional view taken substantially along line 2-2 in FIG. 1 of a sail with increased camber including venting assembly aperture and air flow.

The construction of the venting assembly 30 for a sail 10 in accordance with the present invention provides high venting efficiency while maintaining the strength and integrity of the sail as illustrated in FIGS. 5 through 8. Each aperture 31 is terminated with a strength member 32 comprising a strapping material or a pocket including a sail batten 33. For long aperture 31 one or more aperture control element 34 comprised of a spacer line 36 pivotally connecting the fore element leach edge 25 of the fore element 24 and the aft element luff edge 27 of the aft element 26 maintaining them substantially adjacent and sail surface 18 parallel, and an equidistant aperture gap 44 along the aperture 31, as show in FIG. 5 (dotted arrows represent extended aperture). For variable control of the aperture gap 44, spacer control line 37 connected to each spacer line 36 are lead down to the foot 14 (not shown) of the sail 10 and pulled to reduce the length of each spacer line 36, reducing or completely eliminating air flow 19. To maintain an equidistant aperture gap 44 proximal to the aperture 31 termination, the spacer line 36 is run through a spreader tube 41 which is rigid and has two ends, a first end 42 which is pivotally connected to the fore element leach edge 25 by the spacer line 36, and a second end 43 which is pivotally connected to the aft element luff edge 27 by the spacer line 36, as shown in FIG. 7. Spreader tube 41 which are located at the end of the aperture 31 proximal to a strength member 32 keep the aperture 31 spread open and maintain the aft element luff edge 30 angled to the windward side 22, and each spreader tube 41 flips around when the sail 10 is tacked. With aperture control element 34 the equidistant aperture gap 44 helps evenly energize the surface boundary layer, and without aperture control element 34 the air flow 19 at the ends of the catenary shaped aperture 31 is reduced as shown in FIG. 8. Although, the high volume of air flow 19 through the middle having a larger aperture gap 44 helps accelerate the slower air flow 19 along the aft element 26 between each aperture 31, having a similar effect as tubercles used on wind turbines to maintain laminar air flow 19, as in US patent publication number 2009/0074578 A1. The best sail 10 performance is obtained with an average aperture gap 44 of between 3% to 6% of the sail 10 chord length 16 for each aperture 31. Aperture 31 can be located along any portion of the sail 10 from the foot 14 of the sail 10 up proximal to the head 12 creating one or more fore element 24 and aft element 26 which can be shared as shown in FIG. 9. Aperture 31 can also be limited substantially proximal to the foot 14 or widest portion of the sail 10 which benefits the most, and reduces the destabilizing moment from the increased lift and drag as shown in FIG. 10. The fore element 24 and aft element 26 can vary in shape according to the location of the aperture 31, as well as the wind range and application of the sail 10, when located substantially proximal to the leach of the sail 10 the aft element functions similar to an aircraft landing flap having a high angle of attach as shown in FIG. 11, and sectional view FIG. 12. Boom-less mainsails, headsails and asymmetrical spinnakers when eased out on a reach have excessive camber and develop air flow 19 separation near the leach which is reduced with venting as shown in FIG. 13, similar to FIG. 2 with additional sail camber. Cat-rig sails without a slot effect from a headsail also benefit, and generally slot venting on any sail 10 helps sustain higher performance within varying angles of attach without stalling, requiring less trimming and trimming knowledge by the sailor.

The present invention has been fully described by way of example with the accompanying drawings. Various alternations and changes can be made without departing from the spirit and broader aspects of the invention as set forth in the appending claims, which are to be interpreted in accordance with the principles of patent law including the doctrine of equivalents.

REFERENCE NUMERAL TABLE

Numeral Description
10 sail
12 head
14 foot
16 chord length
18 sail surface
19 air flow
22 windward side
23 leeward side
24 fore element
25 fore element leach edge
26 aft element
27 aft element luff edge
30 venting assembly
31 aperture
32 strength member
33 sail batten
34 aperture control element
35 in-plane axis
36 spacer line
37 spacer control line
41 spreader tube
42 first end
43 second end
44 aperture gap
45 wing surface

I claim:

1. A sail having a thin airfoil shape a sail surface having air flow a windward and leeward side a head a foot a chord length, a venting assembly comprising one or more aperture having an aperture gap separating a fore element having a fore element leach edge and an aft element having an aft element luff edge forming said aperture, each said aperture is coplanar having an in-plane axis substantially perpendicular with respect to said sail surface and said fore element leach edge is disposed substantially adjacent to said aft element luff edge and substantially perpendicular with respect to said air flow when under sail, channeling air from said windward side of said sail through said aperture to said leeward side of said sail parallel to said sail surface, thereby energizing the surface boundary layer and maintaining laminar air flow along said aft element; each aperture having one or more aperture control element comprised of a spacer line pivotally connecting said fore element leach edge and said aft element luff edge, maintaining said fore element leach edge substantially adjacent to said aft element luff edge and said sail surface substantially parallel, with a substantially equidistant said aperture gap along said aperture when under sail on either tack, and said aperture are centrally located on said sail separating said fore and said aft element.

2. A sail recited in claim 1 wherein said aperture control element comprises said spacer line therethrough a spreader tube having two ends, a first end connected pivotally to said fore element leach edge and a second end pivotally to said aft element luff edge allowing said spreader tube to rotate when said sail is tacked, and both ends are connected proximal to the termination of said aperture.

3. A sail recited in claim 1 further in which each spacer line is connected to a spacer control line leading down to said foot of said sail enabling manually control of the spacer line length to reduce the size or completely close said aperture gap, whereby eliminating or controlling the amount of said air flow through said aperture gap.

4. A sail recited in claim 1 each aperture is terminated by a strength member substantially perpendicular to said aperture.

5. A sail recited in claim 4 further in which said strength member is comprised having a sail batten.

* * * * *